US011594812B2

(12) United States Patent
Anderson

(10) Patent No.: US 11,594,812 B2
(45) Date of Patent: Feb. 28, 2023

(54) DIRECTIONAL ANTENNA ARRAYS AND METHODS

(71) Applicant: Taoglas Group Holdings Limited, San Diego, CA (US)

(72) Inventor: Christopher M. Anderson, San Diego, CA (US)

(73) Assignee: TAOGLAS GROUP HOLDINGS LIMITED, Enniscorthy (IE)

( * ) Notice: Subject to any disclaimer, the term of this patent is extended or adjusted under 35 U.S.C. 154(b) by 390 days.

(21) Appl. No.: 16/632,287

(22) PCT Filed: Jul. 9, 2018

(86) PCT No.: PCT/IB2018/000857
§ 371 (c)(1),
(2) Date: Jan. 17, 2020

(87) PCT Pub. No.: WO2019/016593
PCT Pub. Date: Jan. 24, 2019

(65) Prior Publication Data

US 2021/0050660 A1 Feb. 18, 2021

Related U.S. Application Data

(60) Provisional application No. 62/534,375, filed on Jul. 19, 2017.

(51) Int. Cl.

| | |
|---|---|
| ***H01Q 1/42*** | (2006.01) |
| ***H01Q 1/12*** | (2006.01) |
| ***H01Q 3/04*** | (2006.01) |
| ***H01Q 21/08*** | (2006.01) |

(52) U.S. Cl.
CPC ..... *H01Q 1/42* (2013.01); *H01Q 1/1257* (2013.01); *H01Q 3/04* (2013.01); *H01Q 21/08* (2013.01)

(58) Field of Classification Search
CPC ..... H01Q 1/42; H01Q 1/1257; H01Q 3/04; H01Q 21/08
See application file for complete search history.

(56) References Cited

U.S. PATENT DOCUMENTS

| | | | | |
|---|---|---|---|---|
| 4,143,378 A | | 3/1979 | Darrouzet | |
| 4,169,226 A | * | 9/1979 | Fukuji | H03J 9/06 398/106 |
| 4,804,972 A | * | 2/1989 | Schudel | H01Q 1/42 343/915 |
| 4,816,836 A | | 3/1989 | Lalezari | |
| 5,357,259 A | | 10/1994 | Nosal | |
| 5,528,253 A | * | 6/1996 | Franklin | H01Q 1/427 343/872 |

(Continued)

OTHER PUBLICATIONS

International Search Report and Written Opinion dated Oct. 23, 2018 for Application No. PCT/IB2018/000857.

*Primary Examiner* — Michael B. Pierorazio
(74) *Attorney, Agent, or Firm* — Garson & Gutierrez, PC

(57) ABSTRACT

Disclosed are devices, systems and methods employing a directional antenna with a single rotational degree of freedom and using multiple signal-quality measurements to define best orientation with respect to a remote communication point and to align the antenna along the highest-signal-quality path. This simplifies alignment upon installation and facilitates higher signal levels, resulting in more reliable communication and higher data throughput.

12 Claims, 4 Drawing Sheets

(56) References Cited

U.S. PATENT DOCUMENTS 6,011,524 A 1/2000 Jervis
6,023,242 A * 2/2000 Dixon ..... H01Q 21/065 342/359
6,072,440 A * 6/2000 Bowman ..... H01Q 1/42 343/872
6,351,249 B1 2/2002 Wolfe, Jr.
6,538,612 B1 * 3/2003 King ..... H01Q 1/125 343/765
6,653,984 B2 11/2003 Park et al.
6,710,749 B2 * 3/2004 King ..... H01Q 1/125 343/765
6,832,070 B1 * 12/2004 Perry ..... H04N 21/4782 348/E7.06
6,864,846 B2 * 3/2005 King ..... H01Q 3/08 343/765
6,904,609 B1 * 6/2005 Pietraszak ..... H04N 21/26283 725/39
6,937,199 B2 * 8/2005 King ..... H01Q 3/04 342/359
7,075,492 B1 * 7/2006 Chen ..... H01Q 19/134 343/781 R
7,076,202 B1 * 7/2006 Billmaier ..... H04N 21/4334 455/66.1
7,239,274 B2 * 7/2007 Lee ..... H01Q 1/3275 342/359
7,301,505 B2 * 11/2007 King ..... H01Q 3/005 343/765
7,324,062 B2 1/2008 Noro et al.
7,423,602 B2 9/2008 Lockie et al.
7,472,409 B1 * 12/2008 Linton ..... H01Q 3/08 343/705
7,484,233 B2 * 1/2009 Pietraszak ..... H04N 21/4532 725/39
7,603,687 B2 * 10/2009 Pietraszak ..... H04N 21/4431 725/50
7,642,961 B1 1/2010 Rausch
7,679,573 B2 * 3/2010 Shuster ..... H01Q 3/08 343/766
7,683,849 B2 3/2010 Schadler et al.
7,685,621 B2 * 3/2010 Matsuo ..... H04N 21/4622 725/38
8,077,113 B2 * 12/2011 Syed ..... H01Q 17/00 343/912
8,269,901 B2 * 9/2012 Yi ..... H03J 7/186 348/731
8,368,611 B2 * 2/2013 King ..... H01Q 3/08 725/63
8,487,813 B2 * 7/2013 Lei ..... H01Q 1/1257 342/359
8,704,711 B2 4/2014 Wang et al.
8,786,514 B2 7/2014 Dickie et al.
8,836,597 B1 * 9/2014 Vizzio ..... H01P 1/066 343/765
8,860,615 B2 10/2014 Wang et al.
9,520,640 B2 12/2016 Truthan
9,551,777 B2 1/2017 Stoddard
9,706,419 B2 7/2017 Bozier et al.
10,476,153 B2 * 11/2019 Anderson ..... H01Q 1/1257
10,923,812 B1 * 2/2021 Schwartz ..... H01Q 1/405
2003/0017852 A1 * 1/2003 Miyatani ..... H01Q 21/29 455/562.1
2003/0051246 A1 * 3/2003 Wilder ..... H04N 7/17318 348/E7.071
2003/0080898 A1 * 5/2003 Wang ..... H01Q 1/42 342/359
2003/0214449 A1 * 11/2003 King ..... H01Q 3/08 343/765
2004/0128689 A1 * 7/2004 Pugel ..... H04N 5/50 725/39
2004/0160375 A1 * 8/2004 King ..... H01Q 3/005 343/765
2004/0166811 A1 * 8/2004 Moon ..... H04B 17/29 455/67.11
2004/0227655 A1 * 11/2004 King ..... H01Q 1/3275 341/176
2005/0108751 A1 * 5/2005 Dacosta ..... H04N 21/6175 348/E5.103
2005/0193415 A1 * 9/2005 Ikeda ..... H04N 21/4586 725/50
2005/0225495 A1 * 10/2005 King ..... H01Q 19/132 343/840
2006/0020978 A1 * 1/2006 Miyagawa ..... H04B 17/27 725/72
2006/0139499 A1 * 6/2006 Onomatsu ..... H04N 21/485 348/731
2006/0170603 A1 * 8/2006 King ..... H01Q 19/10 343/765
2006/0187117 A1 * 8/2006 Lee ..... H01Q 1/1257 342/359
2007/0152897 A1 * 7/2007 Zimmerman ..... H01Q 1/28 343/757
2008/0129885 A1 * 6/2008 Yi ..... H03J 7/186 348/731
2008/0136722 A1 * 6/2008 King ..... H01Q 1/42 342/359
2008/0186242 A1 * 8/2008 Shuster ..... H01Q 19/17 343/762
2008/0186409 A1 * 8/2008 Kang ..... H04N 21/426 348/731
2008/0246677 A1 * 10/2008 Shuster ..... H01Q 1/1257 343/766
2009/0135309 A1 * 5/2009 DeGeorge ..... H04N 21/4345 348/732
2009/0260038 A1 * 10/2009 Acton ..... H04N 21/482 725/49
2009/0310030 A1 * 12/2009 Litwin ..... H04N 21/4345 348/731
2010/0214482 A1 * 8/2010 Kang ..... H04N 21/235 348/731
2010/0315307 A1 * 12/2010 Syed ..... H01Q 17/00 343/872
2011/0126232 A1 * 5/2011 Lee ..... H04N 21/6405 707/E17.049
2013/0207868 A1 * 8/2013 Venghaus ..... H01Q 19/12 343/840
2016/0104942 A1 * 4/2016 Pera ..... H01Q 1/523 343/836
2016/0359224 A1 * 12/2016 Mellor ..... H01Q 1/1228
2017/0179592 A1 * 6/2017 Anderson ..... H04B 17/102
2019/0207303 A1 * 7/2019 Porter ..... H01Q 1/42
2019/0237850 A1 * 8/2019 Fleischer ..... H01Q 1/2291
2021/0066780 A1 * 3/2021 Fleischer ..... H01Q 3/04

* cited by examiner

DIRECTIONAL ANTENNA ARRAYS AND METHODS

CROSS-REFERENCE

This application claims the benefit of U.S. Provisional Application No. 62/534,375, filed Jul. 19, 2017, entitled DIRECTIONAL ANTENNA ARRAYS AND METHODS, which application is incorporated herein by reference.

BACKGROUND

Field: The present disclosure relates in general to an antenna and, in particular, to devices and methods for orienting a directional antenna array.

As wireless communications proceed toward realization of next-generation wireless communications infrastructure, millimeter-wave (mmW) and near-millimeter-wave frequencies will play a foundational role in 5G systems because of the massive bandwidth available to support high data rates and greater throughput demanded by end users.

Compared to lower frequency bands currently in use, a major drawback associated with these high frequencies is high propagation loss (which results in shorter travel distance), poor building penetration, as well as environmental and atmospheric absorption which may further limit travel distance and communications integrity. Such systems require a greater number of base stations to cover a given area as well as numerous high-gain customer premises equipment (CPE) antennas to ensure reliable, high data-rate communications.

However, the extremely short wavelengths of millimeter-wave signals make it feasible for very small antennas to concentrate signals into highly-focused beams with enough gain to overcome propagation losses. The highly focused beams associated with these systems make the already-formidable effort associated with achieving accurate alignment of antennas that much more difficult. What is needed are easily-aligned antenna systems along with alignment methods that together reduce the time, difficulty and overall costs associated with installation and alignment.

SUMMARY

Disclosed are tunable communication devices. Suitable tunable communication devices comprise: a partially cylindrical antenna body having a side wall and an upper surface with a face on a portion of the side wall, and an interior surface and an exterior surface; one or more directional antennas mounted on the exterior surface of the face of the partially cylindrical antenna body wherein the one or more directional antennas are facing a single direction; an antenna driver configurable to control a rotation of the partially cylindrical antenna body around a single axis to point the directional antenna array in a direction within a plane of rotation; and a cylindrical radome enclosing the partially cylindrical antenna body. The one or more directional antennas are configurable to communicate with a remote station, such as a Wi-Fi access point or a cellular base station. A signal quality evaluator can be provided which is configurable to evaluate the quality of a plurality of input signals from the one or more directional antennas, and compare the plurality of input signals from the one or more directional antennas to identify an input and generate a route signal to instruct the antenna driver to steer the antenna towards an orientation corresponding to the highest quality input signal.

Additionally, the interior of the partially cylindrical antenna body encloses one or more of electronic systems and mechanical systems.

Another aspect of the disclosure is directed to methods of operating a tunable communication device. Suitable methods comprise the steps of: (a) rotating a tunable communication device having a partially cylindrical antenna body having a side wall and an upper surface with a face on a portion of the side wall, and an interior surface and an exterior surface, one or more directional antennas mounted on the exterior surface of the face of the partially cylindrical antenna body wherein the one or more directional antennas are facing a single direction, an antenna driver configurable to control a rotation of the partially cylindrical antenna body around a single axis to point the directional antenna array in a direction within a plane of rotation, and a cylindrical radome enclosing the partially cylindrical antenna body; (b) receiving a signal from a base station; (c) determining the quality of the signal from the base station; (d) rotating the partially cylindrical antenna body about an axis by a specific increment; (e) repeating steps (a)-(d) until a plurality of signals are received for a target rotational range of the partially cylindrical antenna body; and (f) selecting a highest quality signal from the plurality of signals received. Additionally, the methods can include the step of: (g) selecting a rotational range smaller than an entire rotational range of the partially cylindrical antenna body on either side of the highest-quality signal; (h) rotating the partially cylindrical antenna body to one end of the smaller rotational range; (i) receiving a signal from the antenna; (j) determining the quality of the signal; (k) rotating the partially cylindrical antenna body by an increment smaller than the specific increment; (l) repeating steps (h)-(k) to acquire multiple signals through the smaller rotational range of the partially cylindrical antenna body; (m) identifying the highest quality signal among the plurality of signals received for the smaller rotational range; and (n) rotating the partially cylindrical antenna body to an orientation corresponding to the highest quality signal identified in step (m). Further steps can include: monitoring a quality of the antenna signal, wherein if the antenna signal quality falls below a threshold value, performing parts (b)-(g), wherein if the highest-quality signal identified subsequently remains below a threshold value, repeating sequentially the step (b). In at least some configurations, the method can include the step of monitoring a quality of the antenna signal, wherein if the highest-quality signal identified subsequently remains below a threshold value, repeating (b)-(g).

Still another aspect of the disclosure is directed to tunable communication systems. Suitable tunable communication systems comprise: a tunable communication device having a partially cylindrical antenna body having a side wall and an upper surface with a face on a portion of the side wall, and an interior surface and an exterior surface, one or more directional antennas mounted on the exterior surface of the face of the partially cylindrical antenna body wherein the one or more directional antennas are facing a single direction, an antenna driver configurable to control a rotation of the partially cylindrical antenna body around a single axis to point the directional antenna array in a direction within a plane of rotation, and a cylindrical radome enclosing the partially cylindrical antenna body; and a remote station in communication with the tunable communication device. The one or more directional antennas can further be configurable to communicate with one or more remote stations, such as a Wi-Fi access point, a cellular base station. A signal quality evaluator can be provided which is configurable to evaluate the quality of a plurality of input signals from the one or more directional antennas, and compare the plurality of input signals from the one or more directional antennas to identify an input and generate a route signal to instruct the antenna driver to steer the antenna towards an orientation corresponding to the highest quality input signal.

Disclosed are means for tunable communication. Suitable means for tunable communication comprise: a partially cylindrical antenna body having a side wall and an upper surface with a face on a portion of the side wall, and an interior surface and an exterior surface; one or more directional antenna means mounted on the exterior surface of the face of the partially cylindrical antenna body wherein the one or more directional antenna means are facing a single direction; an antenna driver configurable to control a rotation of the partially cylindrical antenna body around a single axis to point the directional antenna means array in a direction within a plane of rotation; and a cylindrical radome enclosing the partially cylindrical antenna body. The one or more directional antenna means are configurable to communicate with a remote station, such as a Wi-Fi access point or a cellular base station. A signal quality evaluator means can be provided which is configurable to evaluate the quality of a plurality of input signals from the one or more directional antenna means, and compare the plurality of input signals from the one or more directional antenna means to identify an input and generate a route signal to instruct the antenna driver to steer the antenna towards an orientation corresponding to the highest quality input signal. Additionally, the interior of the partially cylindrical antenna body encloses one or more of electronic systems and mechanical systems.

Another aspect of the disclosure is directed to methods of operating a tunable communication device. Suitable methods comprise the steps of: (a) rotating a tunable communication device having a partially cylindrical antenna body having a side wall and an upper surface with a face on a portion of the side wall, and an interior surface and an exterior surface, one or more directional antenna means mounted on the exterior surface of the face of the partially cylindrical antenna body wherein the one or more directional antenna means are facing a single direction, an antenna driver configurable to control a rotation of the partially cylindrical antenna body around a single axis to point the directional antenna means array in a direction within a plane of rotation, and a cylindrical radome enclosing the partially cylindrical antenna body; (b) receiving a signal from a base station; (c) determining the quality of the signal from the base station; (d) rotating the partially cylindrical antenna body about an axis by a specific increment; (e) repeating steps (a)-(d) until a plurality of signals are received for a target rotational range of the partially cylindrical antenna body; and (f) selecting a highest quality signal from the plurality of signals received. Additionally, the methods can include the step of: (g) selecting a rotational range smaller than an entire rotational range of the partially cylindrical antenna body on either side of the highest-quality signal; (h) rotating the partially cylindrical antenna body to one end of the smaller rotational range; (i) receiving a signal from the antenna; (j) determining the quality of the signal; (k) rotating the partially cylindrical antenna body by an increment smaller than the specific increment; (l) repeating steps (h)-(k) to acquire multiple signals through the smaller rotational range of the partially cylindrical antenna body; (m) identifying the highest quality signal among the plurality of signals received for the smaller rotational range; and (n) rotating the partially cylindrical antenna body to an orientation corresponding to the highest quality signal identified in step (m). Further steps can include: monitoring a quality of the antenna signal, wherein if the antenna signal quality falls below a threshold value, performing parts (b)-(g), wherein if the highest-quality signal identified subsequently remains below a threshold value, repeating sequentially the step (b). In at least some configurations, the method can include the step of monitoring a quality of the antenna signal, wherein if the highest-quality signal identified subsequently remains below a threshold value, repeating (b)-(g).

Still another aspect of the disclosure is directed to tunable communication systems. Suitable tunable communication systems comprise: a tunable communication device having a partially cylindrical antenna body having a side wall and an upper surface with a face on a portion of the side wall, and an interior surface and an exterior surface, one or more directional antenna means mounted on the exterior surface of the face of the partially cylindrical antenna body wherein the one or more directional antenna means are facing a single direction, an antenna driver configurable to control a rotation of the partially cylindrical antenna body around a single axis to point the directional antenna means array in a direction within a plane of rotation, and a cylindrical radome enclosing the partially cylindrical antenna body; and a remote station in communication with the tunable communication device. The one or more directional antenna means can further be configurable to communicate with one or more remote stations, such as a Wi-Fi access point, a cellular base station. A signal quality evaluator means can be provided which is configurable to evaluate the quality of a plurality of input signals from the one or more directional antenna means, and compare the plurality of input signals from the one or more directional antenna means to identify an input and generate a route signal to instruct the antenna driver to steer the antenna towards an orientation corresponding to the highest quality input signal.

INCORPORATION BY REFERENCE

All publications, patents, and patent applications mentioned in this specification are herein incorporated by reference to the same extent as if each individual publication, patent, or patent application was specifically and individually indicated to be incorporated by reference.

_____, Low Cost Phased Array Antennas for BWA Applications. Microwave J. 45:5 324(3) (May 2002);

TEWARI et al Simulation of a Microstrip Patch Antenna at 2.8 GHz, Indian J. Sci. Res 7(2): 189-199 (2017);

US 2016/0104942 A1 published Apr. 14, 2016 to Pera et al. for Multi-Sector Antennas;

U.S. Pat. No. 4,143,378 A issued Mar. 6, 1979 to Darrouzet for Pendulum Antenna;

U.S. Pat. No. 4,816,836 A issued Mar. 28, 1989 to Lalezari for Conformal Antenna and Method;

U.S. Pat. No. 5,357,259 A issued Oct. 18, 1994 to Nosal for Aircraft Deployable Rotating Phased Array Antenna;

U.S. Pat. No. 6,011,524 A issued Jan. 4, 2000 to Jervis for Integrated Antenna System;

U.S. Pat. No. 6,351,249 B1 issued Feb. 26, 2002 to Wolfe Jr. for Roof-Mounted Dish Antenna Housing;

U.S. Pat. No. 6,653,984 B2 issued Nov. 25, 2003 to Park et al. for Electronically Scanned Dielectric Covered Continuous Slot Antenna Conformal to the Cone for Dual Mode Seeker;

U.S. Pat. No. 7,324,062 B2 issued Jan. 29, 2008 to Noro et al. for Antenna Unit;

U.S. Pat. No. 7,423,602 B2 issued Sep. 9, 2008 to Lockie et al. for Multiple-Point to Multiple-Point Communication System;

U.S. Pat. No. 7,642,961 B1 issued Jan. 5, 2010 to Rausch for Remote Control Antenna Positioning System;

U.S. Pat. No. 7,683,849 B2 issued Mar. 23, 2010 to Schadler et al. for System and Method of Producing a Null Free Oblong Azimuth Pattern with a Vertically Polarized Traveling Wave Antenna;

U.S. Pat. No. 8,860,615 B2 issued Oct. 14, 2014 to Wang et al. for Antenna for Vehicles;

U.S. Pat. No. 9,520,640 B2 issued Dec. 13, 2016 to Truthan for Electromagnetically Coupled Broadband Multi-Frequency Monopole with Flexible Polymer Radome Enclose for Wireless Radio;

U.S. Pat. No. 9,551,777 B2 issued Jan. 24, 2017 to Stoddard for Direction Finding Using Antenna Array Rotation; and U.S. Pat. No. 9,706,419 B2 issued Jul. 11, 2017 to Bozier et al. for Antenna Apparatus and Method of Performing Spatial Nulling within the Antenna Apparatus.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Figure 1A:
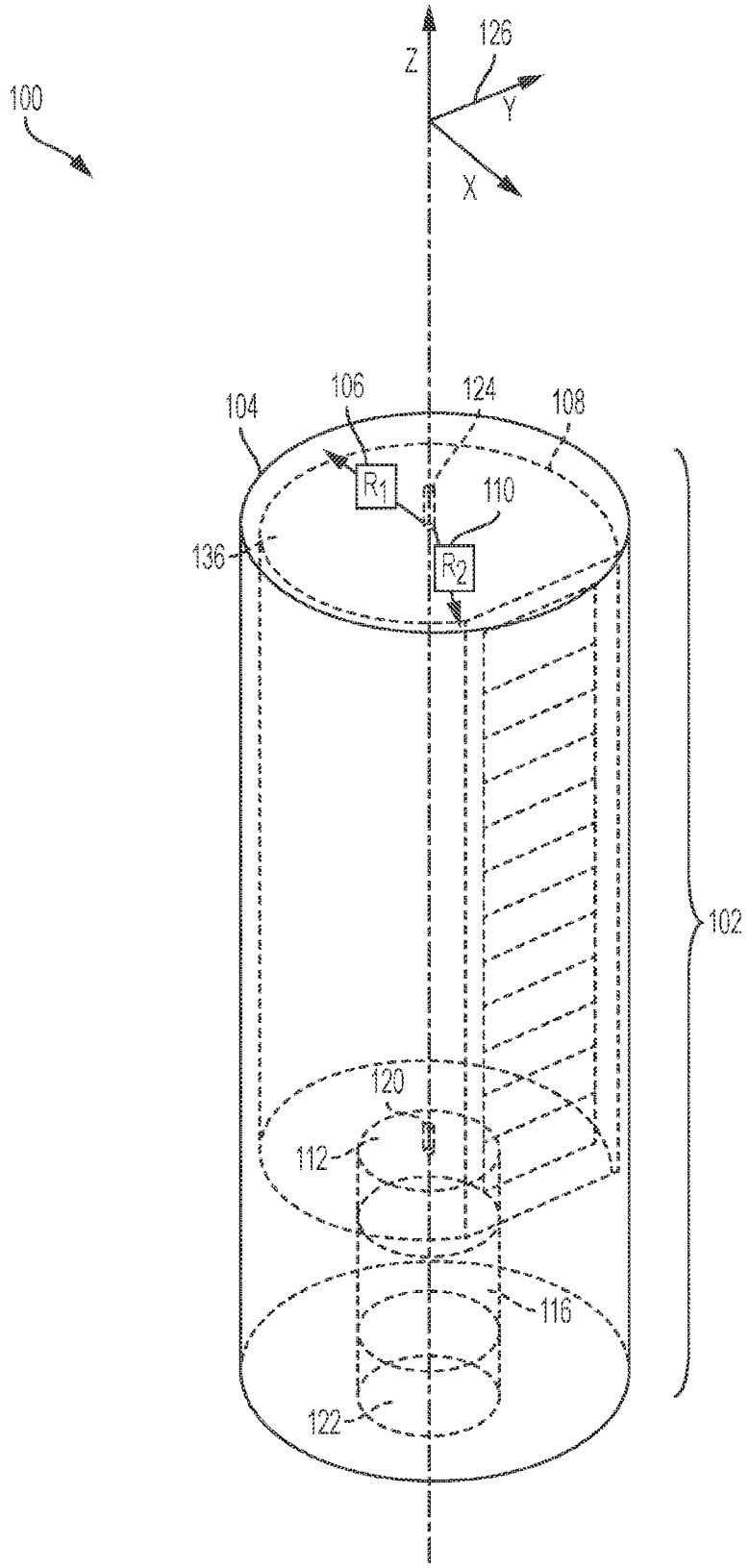
FIG. 1A is an isometric illustration of the disclosed antenna system.

Referring now to FIG. 1A, an isometric view of an exemplar system is presented. The antenna system 100 comprises the following elements: a radome enclosure 104, and an antenna assembly 102, a component of which is a directional antenna. The antenna assembly 102 comprises the antenna body 108, electric motor 112, driver module 116, and a signal quality evaluator module (SQEM) 122. The radome enclosure 104 is a closed hollow cylinder of circular cross-section which completely encases antenna assembly 102. The radome enclosure 104 is transparent to radio waves and provides protection from the elements for antenna assembly 102. The long axis of the radome enclosure 104 is parallel to the z-axis of coordinate system 126. The cross-section of the radome enclosure 104 is circular and lies parallel to the x-y plane of coordinate system 126. The cross-sectional radome radius R1 106 is sufficiently larger than the antenna body major radius R2 110 to allow free rotation of the antenna body 108 about the z-axis of coordinate system 126 within the radome enclosure 104.

In the embodiment depicted in FIG. 1A, the upper spindle 124 protrudes from the antenna body top surface 136, coincident with the z-axis of coordinate system 126. The upper spindle 124 engages the radome enclosure 104 while retaining a rotational degree of freedom about the z-axis of coordinate system 126, freeing the antenna body 108 to rotate within the radome enclosure 104. The electric motor 112, driver module 116, and SQEM 122 reside within, and are rigidly attached to radome enclosure 104. The motor driveshaft 120 is rigidly coupled to the antenna body 108 enabling rotation of the antenna body 108 about the z-axis of coordinate system 126 when sufficient motive torque is supplied by the electric motor 112. Note that other physical configurations are possible in different embodiments, including for example, a configuration in which the electric motor 112, driver module 116, and SQEM 122 reside within the antenna body 108. Other embodiments may entail one or two of the electric motor 112, driver module 116, and SQEM 122 residing inside antenna body with the remaining elements residing outside the antenna body 108 and within the radome enclosure 104. Still other embodiments may entail one or more of the electric motor 112, driver module 116, and SQEM 122 residing external from the radome enclosure 104.

Figure 1B:
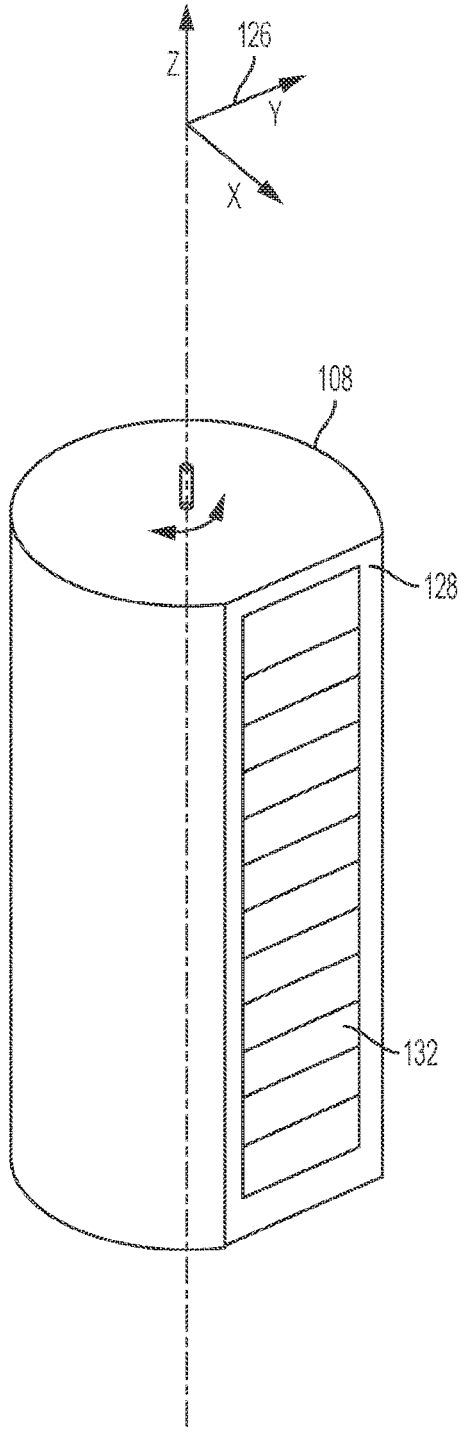
FIG. 1B is an isometric illustration of an antenna assembly according to the disclosure.

FIG. 1B is an isometric view of an exemplar antenna body 108. The antenna body 108 takes the form of a cylinder of truncated circular cross-section with sufficient volume to house electronics associated with antenna assembly 102. Referring to coordinate system 126, the long axis of the antenna body 108 is parallel to the z-axis. The planar truncation runs parallel to the y-z plane of coordinate system 126, which results in a planar rectangular surface that forms the antenna face 128. Antenna 132, depicted as a rectangle, is a directional antenna which resides on antenna face 128. Although antenna 132 is depicted as a rectangle, it may take a number of physical forms; antenna 132 may, for example, comprise a single element antenna or a multi-element antenna array. As will be appreciated by those skilled in the art, the antenna face could be convex, concave or flat.

Note that other physical configurations are possible in different embodiments, including for example, one in which an antenna body is entirely cylindrical and a conformal antenna array resides upon the cylindrical exterior of the antenna body. Still other embodiments may contain more than one planar surface, each with an antenna array residing upon it.

Figure 2:
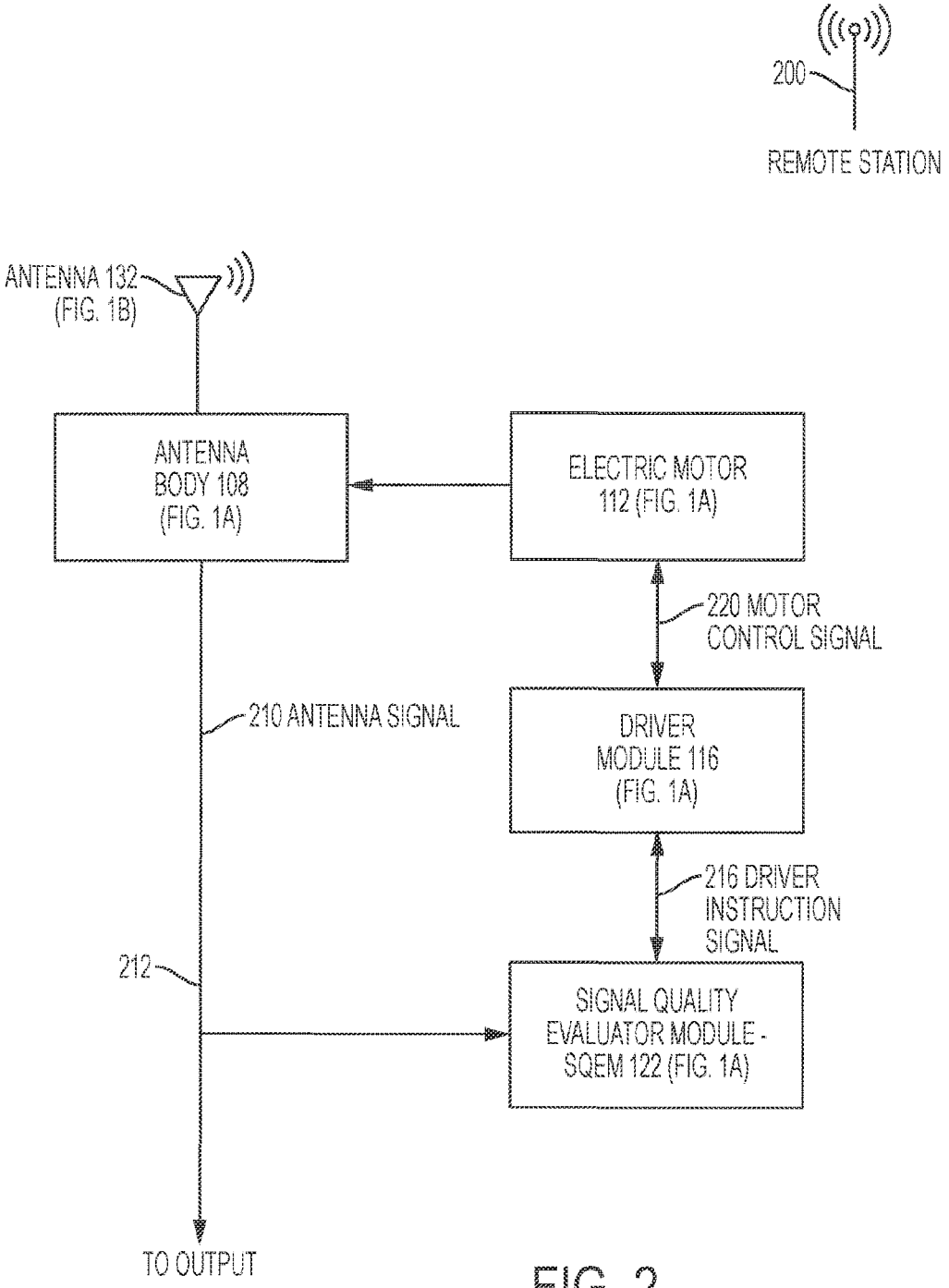
FIG. 2 is a block diagram of an antenna system according to the disclosure which depicts the functional interaction of various elements in the system.

FIG. 2 is a block diagram depiction of the disclosure. In the context of this communications system, the remote station 200 represents the remote end of a wireless communications link, wherein the geographic position and orientation of the remote station 200 is unknown or not precisely known. Examples of the communications system this scheme may apply to include, for example, Wi-Fi and cellular communications systems and any other systems having a remote wireless remote station.

The system illustrated in the block diagram, comprising antenna 132 (FIG. 1B), antenna body 108 (FIG. 1A), electric motor 112 (FIG. 1A), driver module 116 (FIG. 1A), and the SQEM 122 (FIG. 1A), may be either fixed or moving with respect to remote station 200. The remote station 200 can be a base station.

The antenna 132 (FIG. 1B) receives an incoming RF energy input and produces a conducted antenna signal 210 which is sent both to the SQEM 122 (FIG. 1A) and out to external electronics via antenna line feed 212. Upon receiving the conducted antenna signal 210 as an input, the SQEM 122 (FIG. 1A) monitors, evaluates, and records the signal quality. Evaluation of the signal quality may be accomplished via any number of schemes, including, for example, magnitude, code correlation, or some combination thereof.

The SQEM 122 may be implemented purely in hardware, as software for instance in a microcontroller, or via some hybrid of the two, as desired.

If warranted by the results of the evaluation of the quality of the conducted antenna signal 210, the SQEM 122 implements one of a diversity of algorithms to engage driver module 116 to reorient the antenna body 108 to point the antenna 132 towards the remote station 200 according to any of a diversity of signal optimization schemes. Such a feedback loop allows for a diversity of search and signal quality optimization algorithms to converge on the best possible signal for a given placement of the disclosed device.

Driver module 116 may be implemented purely in hardware, as software for instance in a microcontroller, or via some hybrid of the two. Driver module 116 is configurable to receive from the SQEM 122 a driver instruction signal 216 corresponding to a target orientation. The driver module 116 then maps the driver instruction signal onto necessary time-variant driver signals required to drive the orientation of the antenna body 108. The driver module 116 then sends a motor control signal 220 to electric motor 112, which then rotates the antenna body 108 through the appropriate angle to achieve desired alignment of antenna assembly 102. In addition, the driver module 116 sends antenna position data back to the SQEM 122 that allows the SQEM 122 to correlate signal quality information with the angular position of antenna 132. In operation, the antenna 132 can eventually be steered to an optimal orientation with respect to remote station 200 given the position of antenna system 100 (FIG. 1A) with respect to remote station 200.

The system can also dynamically adapt to a changing signal quality and orientation. Note that the maximum speed permissible for the disclosed system to still function is limited by the speed of the system's ability to converge to and lock onto an orientation that keeps the signal quality of the signal above a minimally accepted threshold.

Specific applications of the disclosed system include:

TABLE 1

ANTENNA APPLICATIONS

| Pointing X where X is | at a Y where Y is |
|---|---|
| Radio | Radio station |
| TV | TV Station |
| Satellite | Satellite |
| Marine Radio | Naval or Coast Guard Transmitter |
| Wifi | Wifi transmitter |
| Cellular | Cellular Transmitter |
| Receiving | Transmitter Antenna |

Figure 3:
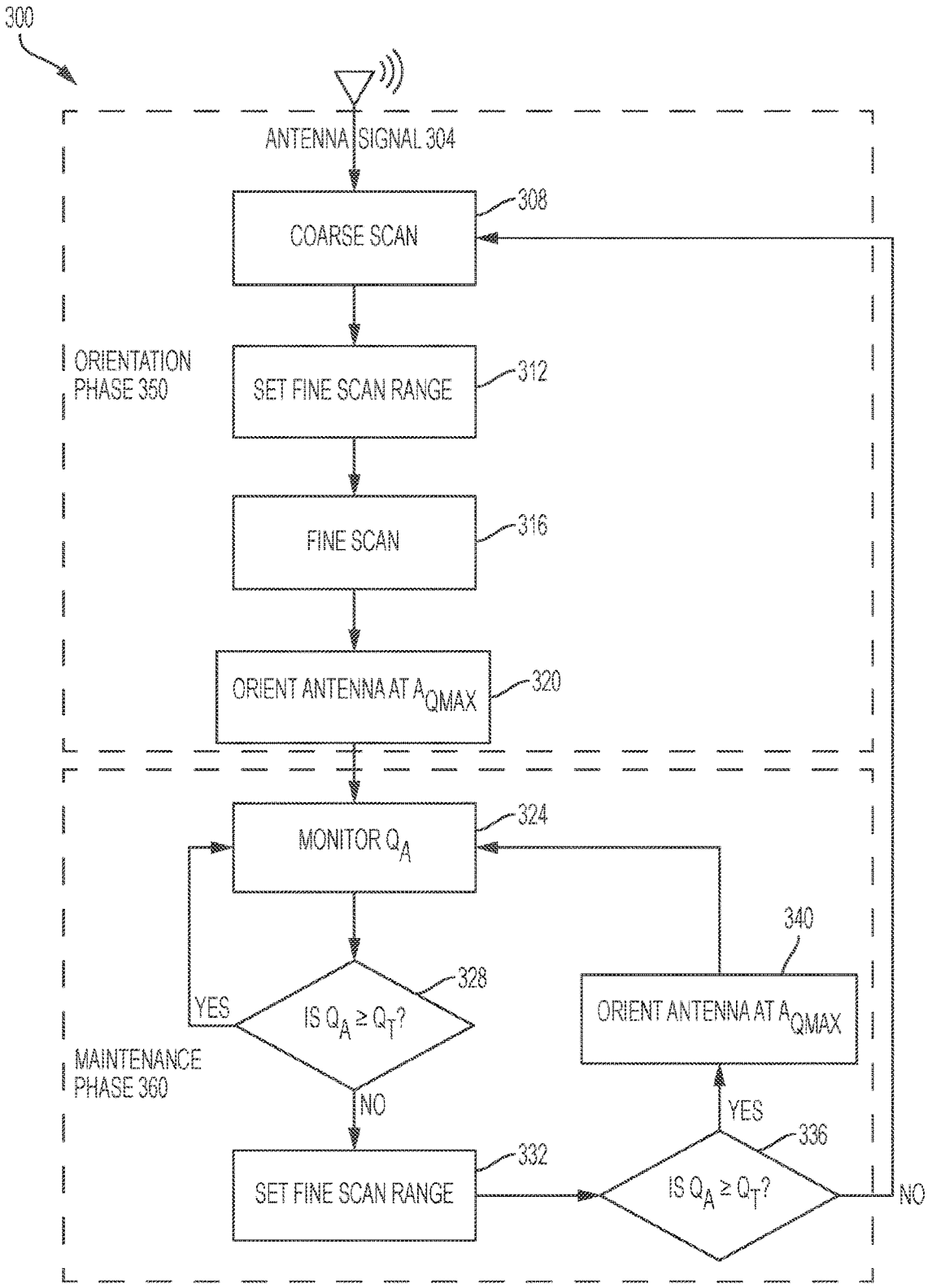
FIG. 3 is a high-level flow chart illustrating an antenna orientation algorithm by which the orientation of the antenna of disclosed system with respect to that of a remote antenna may be established and maintained during operation.

FIG. 3 is a high-level flow chart illustrating one version of an antenna orientation algorithm 300 by which the orientation of the antenna of disclosed system with respect to that of a remote antenna may be established and maintained during operation. The antenna orientation algorithm 300 comprises two components: an orientation phase 350 and a maintenance phase 360. The orientation phase 350 occurs either following first installation of the antenna system 100 (FIG. 1A) or when antenna signal quality, $Q_A$, falls below a threshold signal quality, $Q_T$, and cannot be recovered above $Q_T$ via the steps in the maintenance phase 360. The orientation phase 350 assumes that the position of the remote station, with which antenna system 100 (FIG. 1A) is attempting to communicate, is not precisely known and lies within the angular range, $R_A$, and of rotation of antenna system 100 (FIG. 1A). For example, if antenna system 100 (FIG. 1A) has an $R_A$ of 360°, the position of the remote station could lie anywhere inside a complete circle with respect to antenna system 100

(FIG. 1A). As another example, if the angular range, $R_A$, of antenna system 100 (FIG. 1A) is only 90°, the position of the remote station would need to lie in a quarter-circle encompassed by $R_A$.

The purpose of the maintenance phase 360 is to monitor antenna signal quality, $Q_A$, and to re-orient the antenna within a limited angular range under two conditions: 1) orientation phase 350 is complete, and 2) antenna signal quality, $Q_A$, falls below a threshold signal quality, $Q_T$. When these two conditions are met, maintenance phase 360 initiates a sequence of steps to bring $Q_A \geq Q_T$. There are two possible outcomes. If maintenance phase 360 fails to result in $Q_A \geq Q_T$, then the orientation phase 350 is re-initiated. Conversely, if maintenance phase 360 results in $Q_A \geq Q_T$, then the system remains in maintenance phase 360, monitoring $Q_A$.

Now, examining FIG. 3, orientation phase 350 is initiated upon a line feed of the antenna signal 304 entering the SQEM 122 (FIG. 1A) for evaluation. SQEM 122 (FIG. 1A) initiates a coarse scan 308 across the entire angular range, $R_A$, of the antenna system 100 (FIG. 1A). The first step of the coarse scan 308, the driver module 116 (FIG. 1A) commands the motor to rotate the antenna 132 (FIG. 1A) to one end of the angular range, $R_A$, upon which the SQEM 122 (FIG. 1A) receives the antenna signal 304, then calculates and stores antenna signal quality, $Q_A$. Next, the SQEM 122 (FIG. 1A) sends a command to driver module 116 (FIG. 1A), which in turn signals commands the motor to rotate the antenna body 108 through a coarse scan interval, $I_C$. For example, if the angular range, $R_A$, of the antenna system is 160°, the coarse scan interval, $I_C$, might be 10°. Once the rotation through one coarse scan interval is complete, the SQEM 122 (FIG. 1A) receives the antenna signal 304, then calculates and stores the antenna signal quality value. The process is repeated throughout the entire angular range, $R_A$, resulting in a set of pairs of signal quality/angle values, $Q_{Ai}/A_{Ci}$.

Once the coarse scan 308 is complete, the next step is determination of the fine scan range 312. The SQEM 122 (FIG. 1A) may use any number of schemes or methods to arrive at the fine scan range, $R_F$. For example, the fine scan range, $R_F$, may be defined by taking a range, equal to one coarse scan interval, $I_C$, on either side of one or more of the highest antenna signal qualities determined in the coarse scan 308. The fine scan interval may be determined in any of a number of ways. For example, it may be pre-determined based on physical characteristics of the antenna, required robustness, necessary accuracy, size of the coarse scan interval, $I_C$, etc., or it may be defined when the fine scan range is determined, based upon, for example, the span of the fine scan range. Conceptually, dividing the scan into coarse and fine steps can increase the speed at which the system converges upon an orientation providing the best signal quality under the given conditions. Such a system can also dynamically adapt to a changing signal quality and orientation. Note that the maximum speed permissible for the disclosed system to still function is limited by the speed of the system's ability to converge to and lock onto an orientation that keeps the signal quality above a minimally acceptable threshold to support the required communication data rate.

The next step in the orientation phase 350 is the fine scan 316. The fine scan 316 is similar to the coarse scan with fine scan range, $R_F$, replacing angular range, $R_A$, and fine scan interval, $I_F$, replacing coarse scan interval, $I_C$. The SQEM 122 (FIG. 1A) initiates the fine scan 316 across the entire angular range, $R_A$, of the antenna system 100 (FIG. 1A). The first step of the fine scan 316, the driver module 116 (FIG. 1A) commands the motor to rotate the antenna 132 (FIG. 1A) to one end of the fine scan range, $R_F$, upon which the SQEM 122 (FIG. 1A) receives the antenna signal 304, then calculates and stores antenna signal quality, $Q_A$. Next, the SQEM 122 (FIG. 1A) sends a command to driver module 116 (FIG. 1A), which in turn signals commands the motor to rotate the antenna body 108 through a fine scan interval, $I_F$. Once the rotation through one fine scan interval is complete, the SQEM 122 (FIG. 1A) receives the antenna signal 304, then derives and stores the antenna signal quality value. The process is repeated throughout the entire fine scan range, $R_F$, resulting in a set of pairs of signal quality/angle values, $Q_{Ai}/A_{Fi}$.

Once the fine scan 316 is complete, the final step in the orientation phase 350 orientation of antenna at angle $A_{QMAX}$ 320, corresponding to the highest antenna signal quality, $Q_{MAX}$. The SQEM 122 (FIG. 1A) sends $A_{QMAX}$ to the driver module 116 (FIG. 1A), which then commands the motor to rotate the antenna 132 (FIG. 1A) to $A_{QMAX}$. Optionally, once maximum signal quality, $Q_{MAX}$, is known, the minimally acceptable threshold signal quality, $Q_T$, value may be established or modified according to a number of measures, for instance, as a percentage of $Q_{MAX}$. Otherwise, the minimally acceptable threshold signal quality, $Q_T$, may be pre-determined and fixed. Once orientation of antenna at angle $A_{QMAX}$ 320 is complete, the system enters maintenance phase 360.

The purpose of maintenance phase 360 is to monitor signal quality, $Q_A$, and to perform or initiate one or more action sequences if signal quality, $Q_A$ falls below a threshold signal quality, $Q_T$. Upon initiation of maintenance phase 360, a line feed of the antenna signal 304 enters the SQEM 122 (FIG. 1A) at a specific periodic rate. Each time a signal is received by the SQEM 122 (FIG. 1A), its antenna signal quality, $Q_A$, is evaluated 324 and compared 328 against a minimally acceptable threshold signal quality, $Q_T$. If antenna signal quality, $Q_A$, is greater than or equal to threshold signal quality, $Q_T$, no action is taken and the SQEM 122 (FIG. 1A), and system state reverts to 324, awaiting the next periodic line feed of the antenna signal 304 for evaluation. If antenna signal quality, $Q_A$, falls below threshold signal quality, $Q_T$, the SQEM 122 (FIG. 1A) initiates fine scan 332, which is identical to fine scan 316. Upon completion of fine scan 332, the SQEM 122 (FIG. 1A), again evaluates antenna signal quality, $Q_A$. Antenna signal quality, $Q_A$, is then compared 338 against a threshold signal quality, $Q_T$. If antenna signal quality, $Q_A$, is greater than or equal to threshold signal quality, $Q_T$, the SQEM 122 (FIG. 1A) sends antenna angle $A_{QMAX}$ 320, corresponding to the highest antenna signal quality, $Q_{MAX}$ to the driver module 116 (FIG. 1A), which then commands the motor to rotate the antenna 132 (FIG. 1A) to the orientation corresponding to $Q_{MAX}$. The system state then reverts to 324, awaiting the next periodic line feed of the antenna signal 304 for evaluation. However, if antenna signal quality, $Q_A$, remains below threshold signal quality, $Q_T$, the system reverts to orientation phase 350, beginning the entire process once again.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A tunable communication device comprising:
an antenna body, the antenna body comprising:
a side wall, the side wall including a substantially planar face;
an upper surface;
an interior surface; and
an exterior surface;
a directional antenna array comprising one or more directional antennas mounted on the exterior surface of the substantially planar face of the partially cylindrical antenna body, the one or more directional antennas facing a single direction;
an antenna driver configured to control a rotation of the antenna body around a single axis to point the directional antenna array in a direction within a plane of rotation;
a cylindrical radome enclosing the partially cylindrical antenna body; and
a signal quality evaluator module configured to:
initiate a course scan through evaluation of a quality of input signals received from the one or more directional antennas as the antenna body is rotated through a plurality of coarse discrete positions in the plane of rotation;
determine a subset of the plurality of coarse discrete positions that correlate with a highest antenna signal quality as the antenna body is rotated through the plurality of coarse discrete positions; and
initiate a fine scan in which the antenna body is rotated through a plurality of fine discrete positions within the subset of the plurality of coarse discrete positions, the plurality of fine discrete positions being of a smaller angular range as compared with the plurality of coarse discrete positions.

2. The tunable communication device of claim 1, wherein the one or more directional antennas are configured to communicate with a remote station.

3. The tunable communication device of claim 2, wherein the remote station comprises a Wi-Fi access point.

4. The tunable communication device of claim 2, wherein the remote station comprises a cellular base station.

5. The tunable communication device of claim 1, wherein the interior of the partially cylindrical antenna body encloses one or more electronic systems.

6. A method of operating a tunable communication device, the tunable communication device having a directional antenna array comprised of one or more directional antennas mounted on an exterior surface of a face of a rotatable antenna body, the method comprising:
rotating the tunable communication device through a plurality of coarse angular positions to point the directional antenna array in a series of discrete directions within a plane of rotation;
receiving a signal from a base station at each of the plurality of coarse angular positions of the tunable communication device;
determining a quality of the signal received from the base station at each of the plurality of coarse angular positions of the tunable communication device;
determining a highest quality signal from the plurality of signals received through each of the plurality of coarse angular positions to determine a subset of the plurality of coarse angular positions; and rotating the tunable communication device through a plurality of fine angular positions within the determined subset of the plurality of coarse angular positions, the plurality of fine angular positions being of a smaller angular range as compared with the plurality of coarse angular positions.

7. The method of claim 6, wherein the rotating of the tunable communication device further comprises:

selecting a rotational range smaller than an entire rotational range of the antenna body on either side of the determined highest quality signal;

rotating the partially cylindrical antenna body to one end of the smaller rotational range;

receiving a plurality of signals during rotation within the smaller rotational range by:

rotating the tunable communication device through the plurality of fine angular positions within the smaller rotational range;

receiving a signal from the antenna at each of the plurality of fine angular positions of the tunable communication device within the smaller rotational range;

determining quality of the signal received at each of the plurality of fine angular positions of the tunable communication device within the smaller rotational range;

identifying a highest quality signal among the plurality of signals received for the smaller rotational range; and rotating the antenna body to an orientation corresponding to the highest quality signal identified within the smaller rotational range.

8. The method of claim 6, further comprising:

monitoring a quality of the antenna signal, and upon receiving a signal that is below a threshold value, repeating the process of rotating the tunable communication device through the plurality of coarse angular positions to point the directional antenna array in the series of discrete directions within the plane of rotation.

9. A tunable communication system, the system comprising:

a tunable communication device comprising an antenna body, the antenna body comprising:

a side wall including a substantially planar face;

an upper surface;

an interior surface; and an exterior surface;

one or more directional antennas mounted on the exterior surface of the substantially planar face of the antenna body, the one or more directional antennas facing a single direction;

an antenna driver configured to control rotation of the antenna body around a single axis to point the one or more directional antennas in a plurality of directions within a plane of rotation;

a cylindrical radome enclosing the antenna body; and a signal quality evaluator module configured to:

initiate a course scan through evaluation of a quality of input signals received from the one or more directional antennas as the antenna body is rotated through a plurality of coarse discrete positions in the plane of rotation;

determine a subset of the plurality of coarse discrete positions that correlate with a highest antenna signal quality as the antenna body is rotated through the plurality of coarse discrete positions; and initiate a fine scan in which the antenna body is rotated through a plurality of fine discrete positions within the subset of the plurality of coarse discrete positions, the plurality of fine discrete positions being of a smaller angular range as compared with the plurality of coarse discrete positions; and a remote station in communication with the tunable communication device.

10. The tunable communication system of claim 9, wherein the one or more directional antennas are configured to communicate with the remote station.

11. The tunable communication system of claim 10, wherein the remote station is at least one of a Wi-Fi access point, and a cellular base station.

12. The tunable communication device of claim 9 wherein the signal quality evaluator module is further configured to:

compare the quality of input signals received from the one or more directional antennas with one another; and generate a route signal to instruct the antenna driver to steer the antenna towards an orientation corresponding to the highest antenna signal quality.

* * * * *